US005312227A

United States Patent [19]

Grateau et al.

[11] Patent Number: 5,312,227

[45] Date of Patent: May 17, 1994

[54] TURBINE CASING DELIMITING AN ANNULAR GAS FLOW STREAM DIVIDED BY RADIAL ARMS

[75] Inventors: Roland M. E. Grateau, Viry Chatillon; Alain J. E. Guibert, Savigny le Temple; Alain J. C. Henu, Le Mee sur Seine; Patrick Kapala, Claye; Jean-Pierre L. Mareix, Avon; Florence J. A. Monchois, Melun; Michel M. Ribault, Athis Mons, all of France

[73] Assignee: Societe Nationale d'Etude et de Construction de Moteurs d'Aviation "S.N.E.C.M.A.", Paris, France

[21] Appl. No.: 990,182

[22] Filed: Dec. 14, 1992

[30] Foreign Application Priority Data

Dec. 18, 1991 [FR] France ..... 91 15692

[51] Int. Cl.[5] ..... F01D 1/02

[52] U.S. Cl. ..... 415/209.3; 415/210.1; 415/142

[58] Field of Search ..... 416/193 A; 415/142, 415/189, 190, 209.3, 209.4, 210.1

[56] References Cited

U.S. PATENT DOCUMENTS

| | | | |
|---|---|---|---|
| 3,024,969 | 3/1962 | Russell | 415/210.1 |
| 3,335,483 | 8/1967 | Howard . | |
| 4,369,016 | 1/1983 | Dennison | 415/142 |
| 4,793,770 | 12/1988 | Schonewald et al. | 415/142 |
| 4,993,918 | 2/1991 | Myers et al. . | |
| 5,161,947 | 11/1992 | Eckfeldt et al. | 415/142 |

FOREIGN PATENT DOCUMENTS

| | | | |
|---|---|---|---|
| 0879487 | 6/1953 | Fed. Rep. of Germany | 415/209.4 |
| 1242290 | 8/1960 | France | 415/209.4 |
| 0068609 | 6/1977 | Japan | 415/189 |

*Primary Examiner*—Edward K. Look
*Assistant Examiner*—Mark Sgantzos
*Attorney, Agent, or Firm*—Oblon, Spivak, McClelland, Maier & Neustadt

[57] ABSTRACT

A turbine casing includes circumferential walls delimiting an annular stream for the flow of gases. The radial arms traversing the stream are completed by a channeling part on the downstream side which is bolted to the arms. The walls are formed of butt-joined tiles assembled together and joined to collars situated on the arms and the channeling parts by riveted ridge tiles. The invention results in a reduction of resistance to the flow of gases, as well as absorption without the production of excessive stresses of the original thermic dilations in the walls.

14 Claims, 4 Drawing Sheets

TURBINE CASING DELIMITING AN ANNULAR GAS FLOW STREAM DIVIDED BY RADIAL ARMS

FIELD OF THE INVENTION

The invention concerns a turbine casing delimiting an annular gas flow stream divided by radial arms.

BACKGROUND OF THE INVENTION

These type of structures are encountered in certain turbojet engines with counter-rotating propellers between the gas generator and the free outlet turbines. Radial arms frequently extend to this location dividing the annular stream into several arcs of a circle. Reference may be made here to U.S. Pat. No. 4,321,007 which shows the structure most closely resembling that of the invention. The stream is actually delimited by two internal and external circumferential walls resting respectively on internal and external collars disposed around each arm. However, the plates or sheets (known as "tiles" in this application) constituting the circumferential walls are welded together and to the arms, this having the drawback of resulting in providing an excessively rigid structure.

SUMMARY OF THE INVENTION

One main object of the invention is to obtain the reduction of internal stresses caused by significant heating, said source of heating residing in the casing and resolved by an assembling mode between the arms and the tiles, said casing then absorbing deformations due to heating without producing any significant stresses in the tiles.

Accordingly, the walls are formed of plates butt-jointed along juncture lines and fixed together and to the collars by mountings constituted by borders for covering the juncture lines and means for clamping the borders on the plates and collars.

Advantageously, the plates and collars overlap the joint lines and the clamping means are rivets fixing the borders to a first plate. A further plate or, depending on the case, another collar is enclosed between the first plate and one border. There is then a slight overlapping of the plates and collars at the joint lines.

Another main object of the invention concerns the improvement of the passage of the stream by the gases, even if the arms have a shape creating high head losses. So as to attain this objective, channeling parts are provided so as to facilitate the arms being bypassed by the gases. These channeling parts comprise a covering provided with means for fixing to a respective arm.

The channeling parts may radially extend beyond the walls and be provided with collars extending the collars of the arms. The support surfaces of the channeling parts to the arms may then extend outside the stream, which further improves the flow.

In a particular case where the channeling parts extend the arms downstream of the flow and the arms are hollow and fitted with openings enabling said arms to be ventilated by an internal cooling current, it is preferable that the channeling parts be recessed and open at at least one of their radial extremities and that the openings have their interior communicate with the interior of the arms. A particular distribution of the ventilation flow is then obtained.

BRIEF DESCRIPTION OF THE DRAWINGS

Reference is now made to the figures, given by way of non-restrictive illustration, to clearly show in detail one embodiment of the invention.

DESCRIPTION OF THE PREFERRED EMBODIMENTS

Figure 1:
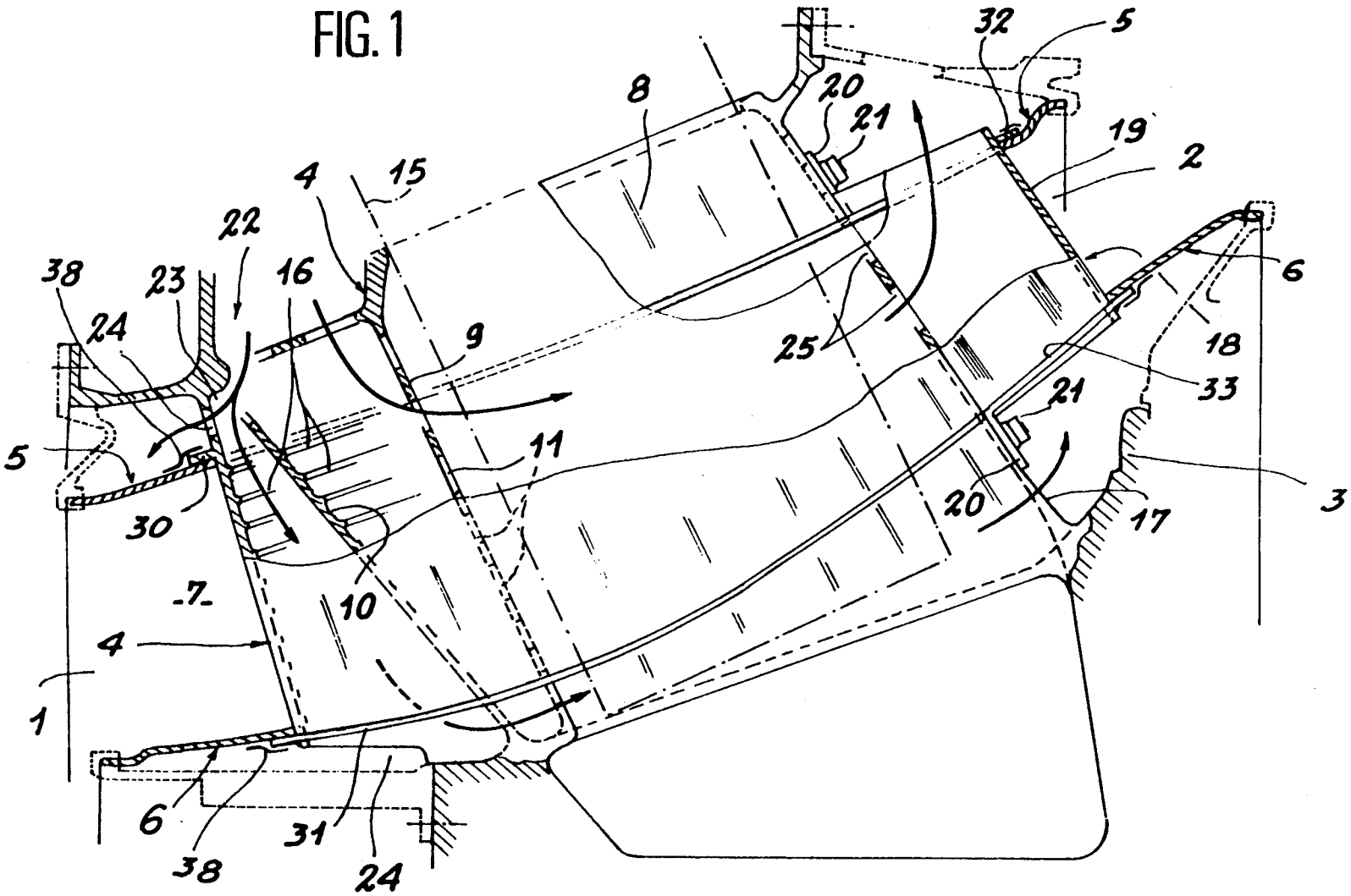
FIG. 1 is an axially cutaway sectional view of one portion of a turbine casing where the invention is implanted.

Reference is firstly made to FIG. 1. The gases derived from a gas generator enter the illustrated portion of the engine via an inlet orifice 1 and traverse it right through as far as an outlet orifice 2 where said gases penetrate into a free outlet turbine. The orifices 1 and 2 are ring-shaped and connected by a casing 3 formed of the assembly of various parts, including the radial arms 4. As the gas flow between the orifices 1 and 2 would be poorly routed by this casing 3 to complicated shaped structures, one external wall 5 and one internal wall 6, both being circumferential and generated by rotation, are added so as to delimit a smooth contoured annular stream 7 in which the gases circulate.

Figure 2:
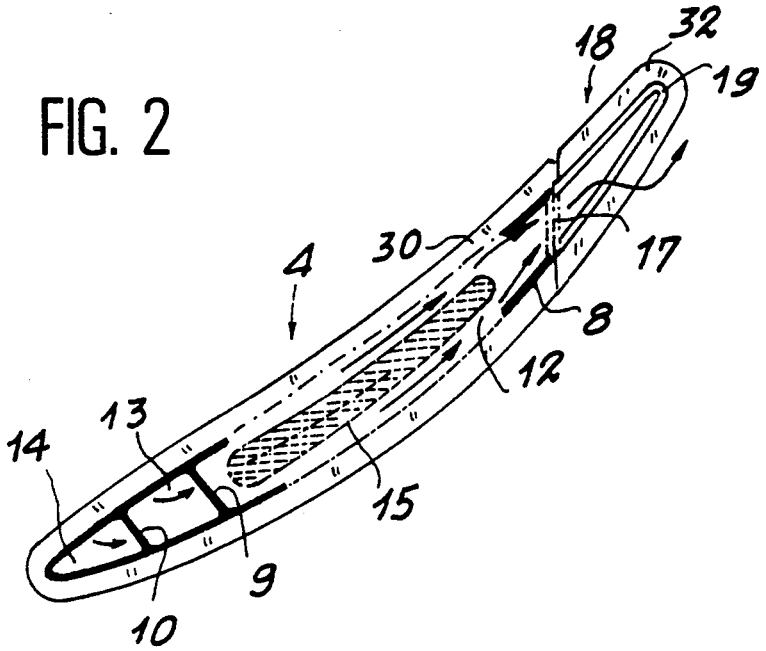
FIG. 2 shows a radial view of an isolated radial arm.

With reference to FIG. 2, the radial arms 4 firstly include one external skin 8 delimiting an internal hollow volume. This volume is divided by two partitions 9 and 10 orientated approximately in the extension direction of the arms 4. The partition 9 is pierced with orifices 11. The other partition 10, situated upstream of the other partition, that is nearer the inlet orifice 1, is on the other hand continuous. Three compartments 12, 13 and 14 are thus delimited from downstream to upstream inside the wall 8. The downstream compartment 12, which is by far the most voluminous, is mainly occupied by a skirt 15 which extends almost as far as the skin 8 and is attached to the skin by not shown attachment means. The other compartments 13 and 14 are partially occupied by cooling blades 16.

On FIG. 2, the arms 4 are profiled so as impede as little as possible with the flow of gases. Their section approximately has the shape of a wing with one upstream edge being slightly tapered and rounded and has slightly bent-in lateral contours. However, for reasons of space, it is not possible to provide the arms with a downstream tapered trailing edge. This is why the skin 8 has one flat downstream face 17 used as a face for assembling it to a built-on part or channeling part 18 which extends the arm 4 so as to constitute the desired tapered trailing edge.

The channeling part 18 has a radial extension much smaller than the arm 4 and may thus extend along the length of the stream 7 much further than the arm 4, that is, almost as far as the outlet orifice 2, without requiring that the shape of the casing 3 be modified.

Figure 4:
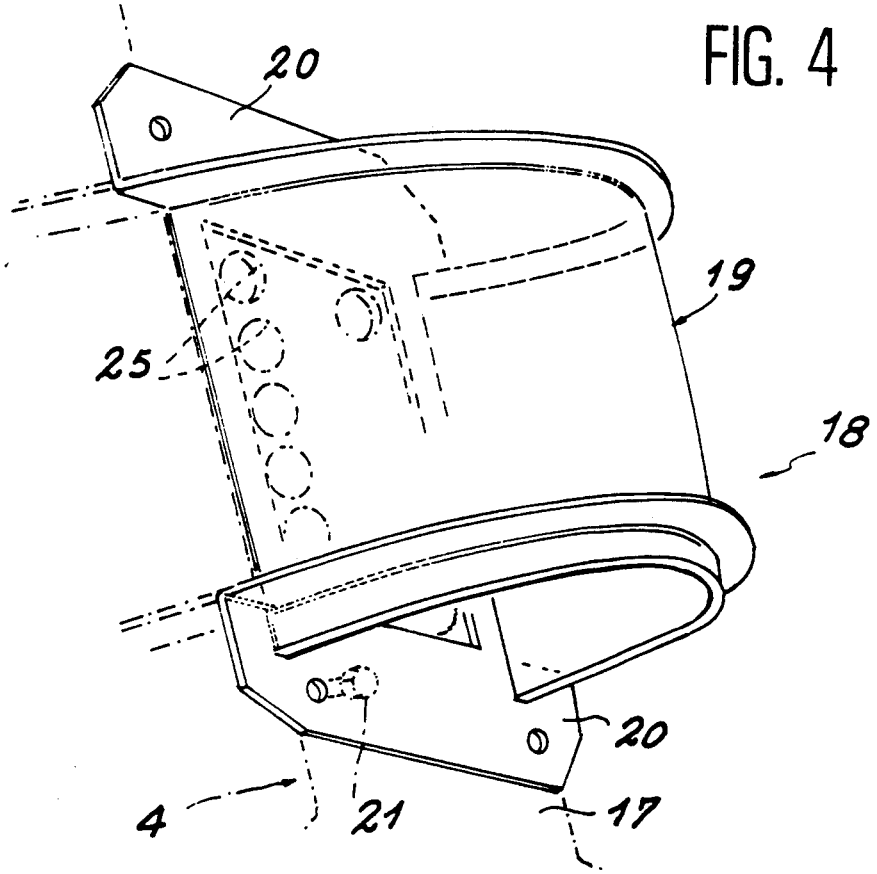
FIG. 4 is a perspective view of the channeling part.

As can also be seen in FIG. 4, the channeling part 18 is mainly composed of a covering 19 radially surpassing the external 5 and internal 6 walls and open at its radial extremities outside the stream 7. At this location, two plates 20 welded to the covering 19 are glued to the front face 17 of the wall and are secured to it by bolts 21 shown on FIG. 1. FIGS. 1 and 2 also illustrate how ventilation of the arms 4 is effected so as to cool their portion situated in the stream 7 and bathed by the flowing hot gases.

Fresh gases originating from another portion of the machine penetrate into the central compartment 13 via a pipe 22. One portion passes through a slot 23 made in the most upstream partition 10 into the upstream compartment 14, then leaves it, via bores 24 in the skin 8, to flow inside and outside the stream 7. Thus, cooling of the external and internal walls 5 and 6 close to the inlet orifice 1 is obtained.

However, most of the ventilation gases pass into the downstream compartment between the skin 8 and the skirt 15 via the orifices 11 prior to leaving it via orifices 25 made in the front face 17. The channeling part 18 and the portion of the external and internal walls 5 and 6 close to the orifice 2 are then ventilated. All the ventilation gases coming out of the covering 19 via its open radial extremities may then be recovered.

Figure 3:
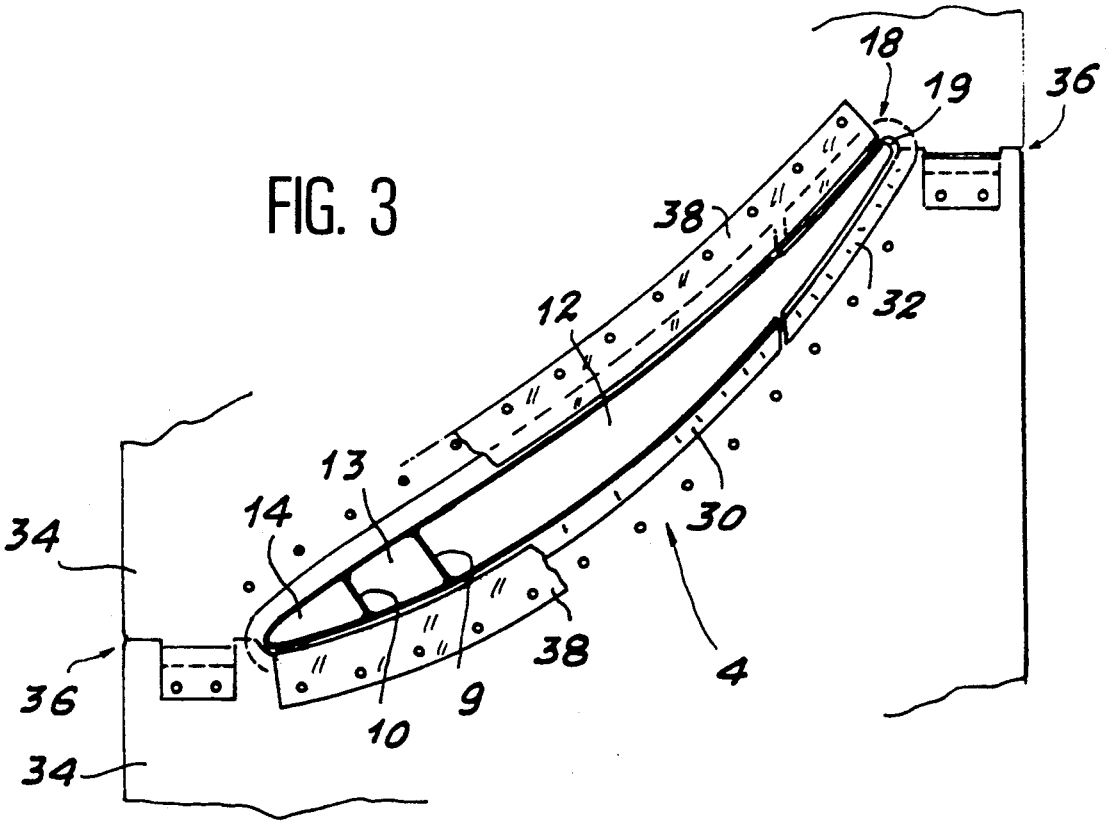
FIG. 3 shows one radial arm and one of the walls delimiting the stream shown as a radial section.
Figure 5:
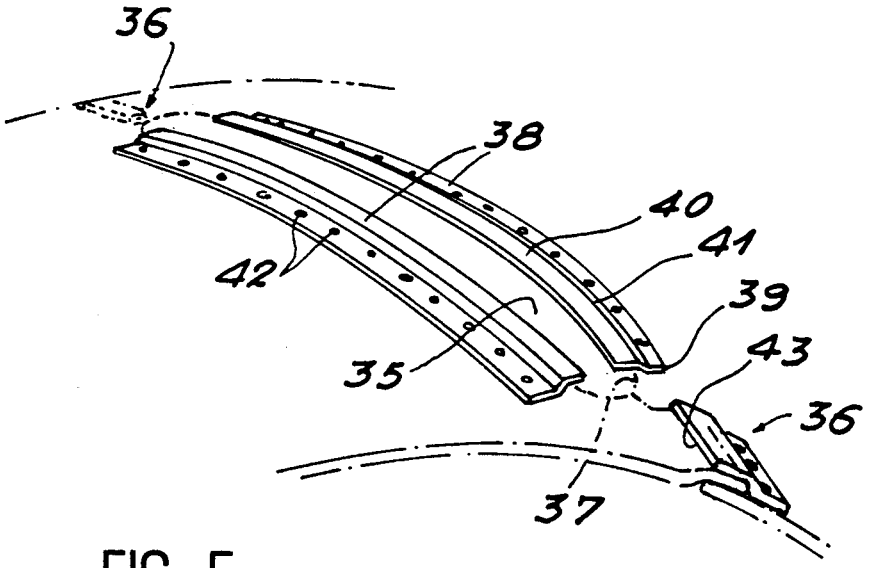
FIG. 5 shows a perspective view of one of the walls.
Figure 6:
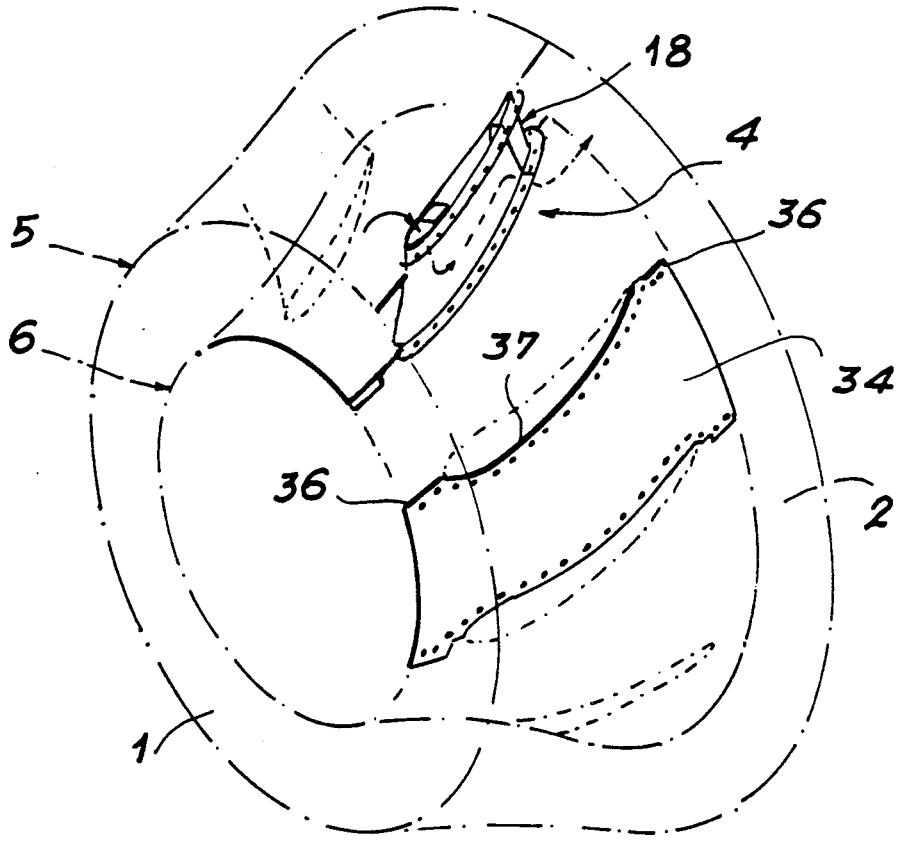
FIG. 6 is a perspective view of a complete diagram of two walls and the radial arms.

As shown in FIGS. 1, 2 and 3, the skin 8 of the arms 4 and the covering 19 of the channeling partitions 18 are provided with two collars, respectively 30, 31 and 32, 33 which rest on the faces outside the stream 7 of the external 5 and internal 6 walls. The collars 30 to 33 are used to assemble the walls 5 and 6 with the arms 4. The external 32 and internal 33 collars of the channeling parts 18 prolong the corresponding collars 30 and 31 of the arms 4 so as to form with the latter two collars with a closed contour. As shown on FIGS. 3, 5 and 6, the walls 5 and 6 are both made up of plates known as butt-ended "tiles" 34 while leaving between them recesses 35 able to be traversed by the arms 4 and the channeling parts 18. For reasons of simplicity of production and mounting, each tile 34 extends between two arms 4 and thus comprises on each side two juncture lines 36 joined to an adjacent tile 34, said lines extending between one extremity downstream or upstream of the tile 34, and one corresponding extremity of one arm 4 or one channeling part 18, and one line 37 joined to the arm 4 and the channeling part 18. The juncture lines 36 and 37 are overlapped by borders or ridge tiles 38 formed of one fixing border 39 and one clamping border 40 separated by a vertical projection 41. The fixing border 39 rests on the tile 34 and is secured to it by a row of rivets 42. The clamping border 40 is intended to clamp either one of the collars 30 to 33 or one bent back edge 43 of the adjacent tile 34 extending beyond the juncture line 36. These bent back edges 43 make it possible to have a stream 7 delimited by fully smooth faces of the external 5 and internal 6 walls. The small amounts of play at the mountings of the tiles 34 does not produce any significant leaks of gas outside the stream 7. No sealing lining is thus required. The tiles 34 which might be subsequently damaged may be easily replaced. In addition, the use of ridge tiles 38 results in the walls having good flexibility and being able to thus absorb any dilations due to heating with reduced stresses.

What is claimed is:

1. A turbine casing, comprising:

two concentric circumferential walls defining an annular gas flow stream;

a plurality of radial arms connected to the walls along first juncture lines and extending between the two walls, wherein the walls comprise plates connected at second juncture lines;

a juncture member provided at at least some of the second juncture lines, which includes two overlapping edges of either two of the plates, either one of the plates and one of the arms, wherein a border is secured to one of the edges and wherein the other of the edges is retained between the border and said one of the edges.

2. Turbine casing according to claim 1, wherein the borders are secured to the edges by rivets.

3. Turbine casing according to claim 1, which comprises a plurality of channeling parts removably fixed to the arms, the channeling parts including a covering for facilitating the gas flow around the arms.

4. Turbine casing according to claim 3, wherein the channeling parts form a downstream extension of the arms along an axial gas flow direction.

5. Turbine casing according to claim 3, wherein the channeling parts comprise edges at the second juncture lines and that continue the edges of the arms, the channeling parts extending through the walls ending outside the stream.

6. Turbine casing according to claim 5, wherein the channeling parts are fixed to the arms at a position located outside the stream.

7. Turbine casing according to claim 3, wherein the channeling parts are bolted to the arms.

8. Turbine casing according to claim 5, wherein the arms are hollow and have openings for the flow of a cooling gas into the arms and out of the arms.

9. Turbine casing according to claim 8, wherein the arms have openings located at portions covered by the channeling parts.

10. Turbine casing according to claim 1, wherein the juncture members at the second juncture lines extend substantially axially and are interrupted by the radial arms.

11. Turbine casing according to claim 10, wherein each of the plates extends between two successive arms of the plurality of arms.

12. Turbine casing according to claim 9, wherein the channeling parts extend through the walls and have open ends located outside the stream.

13. Turbine casing according to claim 8, wherein the arms have a hollow space and comprise a substantially radial inner wall dividing the hollow space of the arms into a first compartment into which the cooling gas is introduced through at least some of the openings and a second compartment, the first and second compartments communicating through additional openings forward in the inner wall.

14. Turbine casing according to claim 13, wherein the first compartment is smaller than the second compartment, and wherein a part extending nearly to the outer skin of the arms is located in the second compartment.

* * * * *